US005174936A

United States Patent [19]

Due et al.

[11] Patent Number: 5,174,936

[45] Date of Patent: Dec. 29, 1992

[54] PROCESS FOR PREPARING YARN COMPONENT SUITABLE FOR USE IN FORMABLE SHEET STRUCTURES

[75] Inventors: Jorgen Due, Silkeborg; Bjarne Graves, Them; Henning Bak, Silkeborg, all of Denmark

[73] Assignee: Hoechst Aktiengesellschaft, Frankfurt am Main, Fed. Rep. of Germany

[21] Appl. No.: 762,637

[22] Filed: Sep. 18, 1991

Related U.S. Application Data

[60] Continuation of Ser. No. 350,312, May 11, 1989, abandoned, Division of Ser. No. 873,426, Jun. 12, 1986, Pat. No. 4,861,535.

[30] Foreign Application Priority Data

Jun. 14, 1985 [DE] Fed. Rep. of Germany ..... 3521479

[51] Int. Cl.[5] ..... D01D 10/02

[52] U.S. Cl. ..... 264/103; 264/235; 264/280; 264/285; 264/345

[58] Field of Search ..... 264/103, 210.8, 211.12, 264/234, 235.6, 345, 235, 280, 285; 57/290; 428/395

[56] References Cited

U.S. PATENT DOCUMENTS

| | | | |
|---|---|---|---|
| 3,305,911 | 2/1967 | Chapman et al. | 28/72 |
| 3,448,573 | 6/1969 | Olen et al. | 264/103 |
| 3,545,057 | 12/1970 | Lubach | 28/1.4 |
| 3,835,510 | 9/1974 | Koslowski | 28/1.4 |
| 4,069,657 | 1/1978 | Bascom et al. | 264/103 |
| 4,086,751 | 5/1978 | Hino et al. | 57/290 |
| 4,098,097 | 7/1978 | Langanke et al. . | |
| 4,153,660 | 5/1979 | Reese | 264/103 |
| 4,233,363 | 11/1980 | Cemel et al. | 264/103 |
| 4,244,174 | 1/1981 | Bobkowicz | 264/103 |
| 4,298,643 | 11/1981 | Miyagawa et al. | 264/257 |
| 4,316,370 | 2/1982 | Steiner | 242/45 |
| 4,554,121 | 11/1985 | Kramers | 264/103 |

FOREIGN PATENT DOCUMENTS

| | | |
|---|---|---|
| 2821243 | 11/1978 | Fed. Rep. of Germany . |
| 1165209 | 9/1969 | United Kingdom . |
| 1387944 | 3/1979 | United Kingdom . |
| 2061174 | 5/1981 | United Kingdom . |
| 2135351 | 8/1984 | United Kingdom . |

OTHER PUBLICATIONS

Derwent Abstract of East German (German Dem. Repub.) Patent 125,918 published May 27, 1976.

Jacob I. et al, Chemiefasein/Textilindustrie 30/82, 114-119, 228-232 (1980).

*Primary Examiner*—James Lowe

[57] ABSTRACT

A yarn component containing at least one filament is prepared by:

selecting at least one partially oriented, undrawn synthetic filament having a birefringence of at least $20\times10^{-3}$ and an elongation at break of 70-200%, and subjecting the thus-selected filament or filaments to a heat treatment at 100°-180° C. under tension. The resulting yarn component has a degree of elasticity under a load of 5 cN/tex of less than 50%, which causes the yarn to be especially well suited for use in formable sheet structures.

8 Claims, 3 Drawing Sheets

PROCESS FOR PREPARING YARN COMPONENT SUITABLE FOR USE IN FORMABLE SHEET STRUCTURES

This application is a continuation of our copending application Ser. No, 07/350,312, filed May 11, 1989, now abandoned, which is a division of our copending application Ser. No. 06/873,426, filed Jun. 12, 1986, now U.S. Pat. No. 4,861,535 issued Aug. 29, 1989.

BACKGROUND OF THE INVENTION

The present invention relates to a process for preparing preferably three-dimensionally formable textile sheet structures, such as woven or knitted fabrics.

A preferably three-dimensional forming of a textile sheet structure can be effected for example by deep-drawing, but also by other techniques known per se. Such textile sheet structures are required for example as outer layer or lining for the interior decoration of motor vehicles and, in general, for the lining of plastics moldings. For example, in the case of a metallic inner panel of a door the textile sheet structure can be laid across or be pressed against the surface and be attached with adhesive. Such textile sheet structures can also be used as covering for items of furniture; that is, wherever an uneven, for example relief like surface is to be coated or covered.

The construction of particularly small radii of curvature gives rise to pronounced deformations in the textile sheet material as a function of the thickness of the material of the textile sheet structure used. In the case of knitwear a three-dimensional forming can be effected from the high constructional stretch usually present, but the constructional stretch of a textile sheet structure produces a corresponding reduction in the weight per unit area in the stretched, exposed areas of the shaped article, which can be a visible flaw, in particular in the case of pile material. Unlike knitwear, the constructional stretch of woven fabrics is usually only low and amounts to only a few percent, so that in this case this type of forming is not available.

The formability of sheet structures is distinctly improved by using, for their preparation, elastic yarns, as is described for example in German Offenlegungsschrift 3,405,209. A disadvantage of such stretch fabrics is the low thermal durability of most of the known elastothreads which, under the high processing temperatures of deep-drawing, can even exhibit degradation reactions. A further disadvantage is the residual elasticity of stretch fabrics, which can lead to detachment of the fabric from the base material, in particular in concavely shaped areas with a small radius of curvature.

Nonwoven textiles usually have a high constructional stretch and a high formability which can be improved still further by using undrawn staple fibers or filaments, as is described for example in German Offenlegungsschrift 3,029,752 for the preparation of industrial filters or in German Auslegeschrift 1,560,797 for the preparation of imitation leather. Nonwovens generally have an exterior of uniformly low structuredness. Textile structures can practically only be indicated by appropriate coloring or embossing.

The prior art further discloses preparing woven textiles from undrawn yarns which have been partially oriented by high-speed spinning. For instance, German Offenlegungsschrift 2,623,904 discloses a textile material for clothing purposes which is prepared from high-speed spun, undrawn yarns without further afterdrawing directly by knitting or weaving. German Offenlegungsschrift 1,460,601 and German Offenlegungsschrift 2,220,713 disclose first knitting or weaving partially oriented, undrawn yarns and only then drawing them within the sheet structure. East German Patent 125,918 discloses a process for preparing textile sheet structures in which partially oriented, undrawn yarns are processed by weaving or knitting into a sheet structure and are subsequently subjected to a thermomechanical treatment within the sheet structure.

However, with this previously disclosed process there is a danger that the yarns are drawn nonuniformly in the course of sheet formation (for example during weft insertion on the weaving machine), which results in variable dyeability of the sheet structure.

The prior art also features a description of a particular application where partially oriented, undrawn filaments are heat-set. German Offenlegungsschrift 2,821,243 describes the preparation of weft yarns which are said to protect the belt yarns required in tire manufacture from nonuniform slipping. Particular value is placed in this context on the reduction in free shrinkage at the sort of high temperatures which occur in the vulcanization of tires. This prior art does not say anything about these filaments or yarns being suitable for textile purposes and in particular for preparing irreversibly highly formable textile sheet structures.

SUMMARY OF THE INVENTION

The present invention thus has for its object to develop processes which permit the preparation of textile sheet structures by weaving or knitting which not only have uniform dyeability but above all are also irreversibly extensible by a once and for all forming process. Since such forming processes usually take place at elevated temperatures, the yarns for these sheet structures must in addition be adequately heat-resistant.

This object is achieved according to the invention with processes on yarns which contain partially oriented, but undrawn polyester filaments and have a number of properties as specified in claim 1. Preferred embodiments of such processes and the properties of the required yarn components form the subject-matter of the subclaims.

In the process of this invention for the production of irreversibly highly formable textile sheet structures it is necessary to use yarns comprising partially oriented, undrawn synthetic filaments which have birefringence values above $20\times10^{-3}$, elongations at break of from 70 to 200% and flow stresses of at least 6CN/tex. The degree of elasticity of such yarns under a load of 5cN/tex has to be less than 50%. Preferably the partially oriented, undrawn filaments consist of polyester, particularly of polyethylene terephthalate.

By using such yarns it is possible to prepare the desired irreversibly highly formable textile sheet structures by weaving or knitting. In this context, "irreversibly highly formable" is to be understood as meaning the property of the textile sheet structure of, in a forming step, for example in deep-drawing, giving way to the applied load and then of substantially remaining irreversible in the spatial shape desired to be brought about by the forming step and not, as would be the case with an elastic textile sheet structure, of recoiling into the original planar shape of the textile sheet structure as a result of the acting restoring forces.

The degree of any three-dimensional formability of a textile sheet structure depends on a plurality of factors and therefore is difficult to define in terms of specific numerical measures. For instance, the radius of curvature, the depth of deformation and the thickness of the textile material all have an effect on the formability. Further factors are for example the slideability of the material to be formed, the way the sheet structure is prepared, the filament denier, the yarn thickness and the like. For that reason "highly formable" is to be understood as meaning in the present specification a formability which is at least sufficient for it to be possible to cover inner linings of automobiles with such textile sheet structures. "Inner linings" includes in particular door linings and the inner lining of the roof.

The yarns required for preparing such textile sheet structures shall be prepared according to the invention from synthetic filaments. In principle it is possible also to use differently textured yarns. However, it is necessary to ensure that the low degree of elasticity prescribed by the present invention can be reached by the yarn. This is usually not the case when the yarn consists of highly elastic, false twist textured filaments. A particularly suitable process is for example air jet texturing, in which even high-bulk yarns having low crimp extensibility can be produced.

The object underlying the invention is achieved by using yarns which consist at least partially of partially oriented, undrawn synthetic filaments. These filaments should have an elongation at break of at least 70%, in particular 70–200%, and a flow stress of at least 6 cN/tex. In preferred embodiments the elongation at break of these filaments should be between 80 and 160%.

The flow stress of these filament should preferably be at least 7 cN/tex.

Flow stress is to be understood as meaning that yarn tension (tensile force divided by starting linear density) at which the stress-strain curve departs from the initially linear course; that is, at which a change in length of the filaments becomes irreversible. The exact starting point of the irreversible change in length is frequently difficult to identify. However, in its place it is possible to use the minimum of the stress-strain curve as a value for the flow force. Such a minimum is customarily observed after the linear rise and a certain overshoot in the flow point as a horizontal branch of the curve. In this region, the length thus increases without an increase in the force. In the case of a high partial orientation of the filaments this minimum is only identifiable as a point of inflection or as a bend in the curve. However, it is in every case possible to determine the flow stress. For example, in the case of only a small bend appearing in the stress-strain curve it is possible to draw tangents to the various sections of the curve. The point where the tangents intersect can then be regarded as the flow stress of this filament.

Partially oriented, undrawn synthetic polymer filaments are customarily prepared by high-speed spinning. The degree of partial orientation can be characterized in terms of the birefringence. In the present case, the birefringence of the filaments should preferably be at least $27\times10^{-3}$, in particular even at least $30\times10^{-3}$. These high-speed spun filaments should preferably not have been subjected additionally to a drawing. As will be emphasized later in the context of the description of the process, no drawing should be associated in the context of a combining or texturing process of the filaments. It is essential that the high-speed spun, partially oriented and undrawn filaments remain intact with their properties; that is, for example, still also have a correspondingly high elongation at break, as indicated above.

The required flow stress of not less than above 6 cN/tex is not reached by commercially available partially oriented, undrawn yarns. The flow stress of these yarns is distinctly below the required limit. If the windup speeds of the yarns are increased to, for example, 5000 m/min, it is true that the required flow stresses are obtained, but these yarns are not suitable for the desired use since, owing to their crystallinity, they produce yarns having excessively high degrees of elasticity. The filaments required according to the invention, therefore, cannot be obtained by means of the customary high-speed spinning alone. In addition to the high-speed spinning it is necessary to carry out a heat treatment under tension which leads to an increase in the flow stress but, on the other hand, leaves the elongation at break resulting in high-speed spinning substantially unchanged.

Yarns required according to the invention have by reason of the increased flow stress the advantageous property that they can be processed by weaving or knitting without danger of nonuniform drawing. In general, partially oriented but still undrawn synthetic polymer filaments are more dyeable than fully drawn filaments. However, if such filaments are processed direct into textile sheet structures this gives rise to temporary and locally high stresses which lead to a partial afterdrawing of the filaments and hence to variable dyeability. Unlike the state of the art it is thus possible to obtain uniform dyeing on the resulting sheet structures after weaving or knitting. Such sheet structures are moreover distinguished, as already singled out in the stated object above, by being irreversibly formable within wide limits even with a once and for all forming process (for example deep-drawing).

Textile sheet structures from such yarns are therefore suitable in particular for use as covering or lining for highly curved surfaces. A further advantage of the yarns required according to the invention is, if the filament-forming synthetic polymers are chosen appropriately, their heat stability.

It is not necessary for the yarns used to consist completely of the filaments having the abovementioned properties, amounts of for example down to 6% being sufficient while, however, mixing ratios of 40–60% by weight of the total linear density of the yarn consisting of the filaments constructed according to the invention being preferred. The prerequisite for such a concomitant use of yarn components which do not have these properties which are necessary according to the invention is that the partially oriented, undrawn synthetic polymer filaments with the specified properties which are necessary according to the invention function as the carrier component in the yarn.

It is known to prepare yarns having a carrier and a non-carrier component by mixing processes, but in particular by texturing processes.

According to the invention, the use of air jet textured yarns is particularly preferred. These yarns can be prepared for example by means of apparatuses as described in German Offenlegungsschriften 2,362,326 and 1,932,706. Herein all filaments can be supplied to the texturing jet with the same overfeed, thereby producing a one-component yarn. However, instead, to produce snarl effects, it is also possible to select different overfeeds, thereby producing a yarn having a carrier and a non-carrier component. The carrier component is formed in this case by the filaments having the smallest overfeed. According to the invention, it is necessary for the partially oriented, undrawn polyester filaments required according to the invention to constitute at least part of the carrier component. Customarily it will consist completely of the filaments according to the invention. However, it is possible to conceive of embodiments in which the carrier component consists of different parts, for example a wrapping yarn or the like. In such a case it is sufficient for the carrier component to consist at least partially of the polyester filaments according to the invention, provided that the undrawn filaments according to the invention determine the behavior of the carrier component in the forming. Under these preconditions it is possible that the yarn can have the required low degree of elasticity of below 50%.

The yarns required according to the invention should have only a low degree of elasticity, which in the case of a load of 5 cN/tex should in every case be below 50%, preferably below 30%.

The degree of elasticity, or the elastic extension ratio, is to be understood as meaning the ratio of the elastic extensibility and total extensibility for a selected tensile force. This tensile force should be in the present case 5 cN/tex. The degree of elasticity can be determined using known test methods. The values given in this specification were determined by measurements in accordance with DIN 53835, part 4, the tensile force, however, not only having been lowered again to the pretensioning force but the filament, after a complete relaxation, having been put again under pretensioning force to determine the residual extension. This measure gives more reproducible values, since the unavoidable play in the measuring apparatus can be eliminated. In the standard mentioned, the degree of elasticity [Elastizitatsgrad] is dealt with under the synonymous designation "Dehnungsverhaltnis' [extensibility ratio].

As already mentioned above, even the carrier component of a textured yarn need not consist completely of the filaments having the properties according to the invention, provided it is ensured that the shape-giving or determining portion of this component consists of filaments having the properties to be required according to the invention. To produce effects, it is also possible to use yarns with modified cross-section, with modified dyeability and the like. It is possible, for example, even to use yarns made of low-flammability raw materials. Any lower extensibility of the non-carrier component can be compensated in full by a corresponding overfeed of the yarn. In the case of correspondingly higher overfeed this component would be present in the yarn in loop form and, if at all, would contribute only to a very minor degree to the physical properties of the overall yarn.

To prepare the yarns required according to the invention it is necessary for at least one filament yarn comprising partially oriented, undrawn synthetic filaments having bi-refringences of at least $20\times10^{-3}$ and elongations at break of 70–200% to be subjected to a heat treatment at 100°–180° C. under tension. When a plurality of yarn components are processed together, it is necessary to ensure that the filament yarn having the properties which are required according to the invention forms the carrier component and therefore is processed with the smallest overfeed.

Surprisingly the heat treatment of partially oriented, undrawn synthetic filament yarns which is proposed according to the invention gives an increase in the flow stress which is sufficient for the purposes of the invention while, however, substantially preserving the high elongation at break of the undrawn yarns.

Preferred temperature ranges of the heat treatment are within the specified range of 100°–180° C., in particular 120°–150° C. Particularly good results were obtained at about 130° C. The heat treatment of the yarns can be carried out for example with steam or in hot air. In a preferred embodiment, the heat treatment of the yarns on cross-wound bobbins is effected in an autoclave with the use of steam. Such steaming processes can be associated for example with the dyeing of the textured combination yarn. Instead, the heat treatment of the yarn can also be effected continuously, for example by means of an apparatus of the type shown in U.S. Pat. No. 4,316,370. It may be pointed out here that the heat treatment of the filaments can be carried out before or after any texturing process. The important point is that in the course of a texturing of the yarns no excessively high stresses are exerted on the yarn components or filaments. Drawing of the yarns in the course of the texturing process should be avoided, as far as possible, since such a measure might reduce the extensibility values of the filaments to be used according to the invention to too high a degree.

The choice of the partial orientation of the filaments required according to the invention, i.e. essentially the windup speed in the high-speed spinning process as well as the temperatures of the heat treatment of the setting process, are to be adapted to the specific requirements on the yarn according to the invention. Since, for example, the forces which arise in the course of weaving usually do not increase linearly with the yarn count, the choice of the yarn count and of the percentage division into carrier and non-carrier (i.e. for example sheath) components can also be used to adapt the processing properties to requirements of further processing.

The invention will now be explained in more detail by means of some illustrative embodiments and related diagrams.

DESCRIPTION OF THE PREFERRED EMBODIMENTS

EXAMPLE 1

To study the stress-strain behavior, tests were first carried out on a one-component yarn which is usable as a carrier component in a multicomponent yarn (combination yarn). For this purpose, commercially available polyethylene terephthalate yarns having a partial orientation corresponding to a birefringence value of $37\times10^{-3}$ and a linear density of dtex 177/f 32 matt were each heat-treated in constant length for 10 minutes with hot air at 120° C. or 150° C. and also with steam at 130° C. The changes in the stress-strain behavior are evident from Table 1 below.

TABLE 1

| | Starting yarn | Heat treatment °C. 120° air | 150° air | 130° steam |
|---|---|---|---|---|
| Breaking force (cN) | 375 | 400 | 400 | 400 |
| Elongation at break (%) | 140 | 125 | 135 | 130 |
| Flow force (cN) | 100 | 125 | 135 | 145 |
| Extension at 200 cN (%) | 85 | 75 | 45 | 50 |

Figure 1:
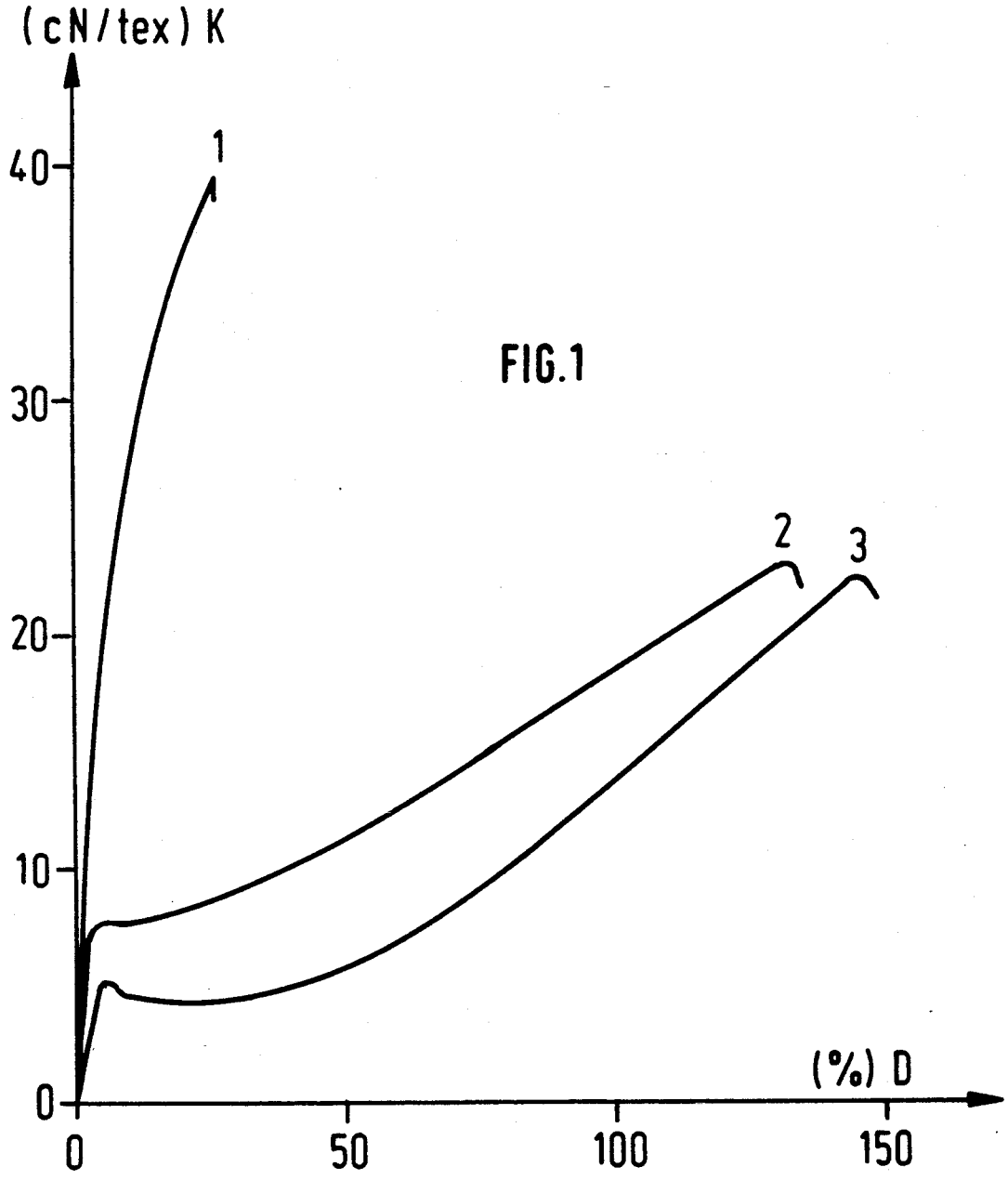
FIGS. 1 and 2 show stress-strain diagrams of various yarns.

An idea of the stress-strain behavior is communicated by the diagram of FIG. 1, in which the yarn stress (K) has been plotted against the strain (D). Curve (3) shows the yarn stress of the abovementioned polyethylene terephthalate yarn before the heat treatment, while curve (2) reproduces the yarn stress of the same yarn after the heat treatment with steam at 130° C. Curve (1), which reproduces the stress-strain behavior of a commercially available yarn which was conventionally drawn after the high-speed spinning process has also been included for comparison.

Comparison of curves (2) and (3) shows that the heat treatment leads to a distinct increase in the linear portion of the stress curve and thus in the flow stress of the yarn. In this, the elongation at break is evidently barely affected. The observed increase in the linear portion of the stress curve explains the advantageous property which can be observed on the yarns according to the invention that the processing of such yarns by weaving or knitting does not give rise to local afterdrawing of yarn portions. This in turn means that a woven or knitted fabric from the undrawn filaments according to the invention has uniform dyeability despite the remaining high extensibility of the material and nonetheless can be processed into textile sheet structures which can be irreversibly formed, for example by deepdrawing.

It is true that yarns having a relatively low partial orientation (for example with birefringence values of less than $20\times10^{-3}$) likewise show an increase in the flow stress after a heat treatment, but this increase is associated with a marked decrease in and a wide scattering of the breaking strength and elongation at break values. On the other hand, an arbitrary increase in the partial orientation as a result of ever higher windup speeds of the filaments is not advisable either. As is known, increasing windup speed is accompanied not only by a partial orientation during the high-speed spinning but also by a crystallization. As a consequence it is no longer possible to produce the desired low degree of elasticity in such yarns. This means, however, that textile sheet structures which have been prepared according to the invention from such yarns are no longer irreversibly formable to a sufficient degree. Instead the formability becomes more and more reversible and elastic, which leads to processing problems in the deepdrawing of such textile sheet structures.

In a second series of tests, a high-speed spun, undrawn bright polyethylene terephthalate yarn having a partial orientation corresponding to a birefringence value of $35\times10^{-3}$ and a count of dtex 128f 48 was heat-treated under tension with steam at 130° C. for 20 minutes. The following values were observed:

TABLE 1a

| | starting yarn | after steaming at 130° C. |
|---|---|---|
| breaking force (cN) | 275 | 275 |
| elongation at break (%) | 151 | 150 |
| flow stress (cN) | 64 | 93 |

EXAMPLE 2

Unlike Example 1, in which only smooth, untextured yarns were used, this example and all the subsequent examples illustrate the preparation of textured yarns. This was done by means of an air jet texturing apparatus as described for example in German Offenlegungsschrift 2,362,326. In each case at least two yarns were air jet textured with different overfeeds; that is, the yarns produced in each case had a carrier component and a non-carrier yarn component and filaments comprising polyethylene terephthalate filaments. The carrier yarn component function was performed by two high-speed spun, yet undrawn, 330-dtex 64-filament polyester yarns with a birefringence of $35\times10^{-3}$. In the texturing process these yarns were presented to the air jet texturing apparatus with an overfeed of 10%. The non-carrier component comprised fully drawn yarn material, namely two 167-dtex 64-filament yarns and a further 167-dtex 32-filament yarn. These three yarns were supplied to the texturing machine with an overfeed of 46%. A textured yarn in accordance with the prior art was prepared for comparison. The non-carrier yarn component was identical to the material described above while the carrier component comprised commercially available, drawn yarns, namely two 167-dtex 64-filament yarns. These yarns were textured together as described above with overfeeds of 10 and 46% respectively. The combination yarns according to the invention were additionally subjected to a heat treatment after texturing: they were wound up on cross-wound bobbins and heat-set in an autoclave for 10 minutes with steam at 130° C.

Figure 2:
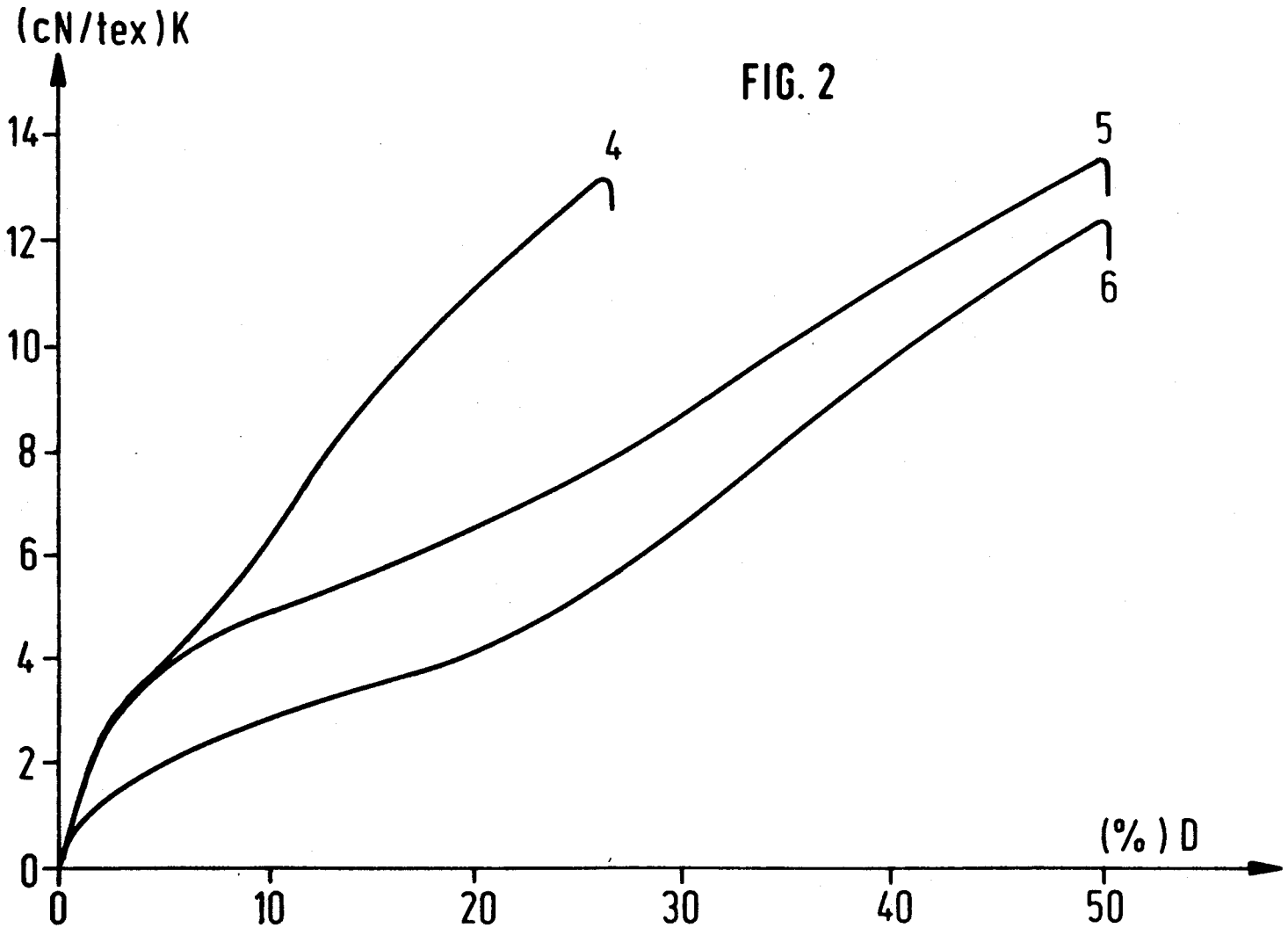

To illustrate the stress-strain curves resulting from the different process measures, the stress-strain curve of the combination yarn according to the invention has been plotted in FIG. 2, where curve (5) applies to the combination yarn according to the invention after the heat treatment, curve (6) reproduces the corresponding values for the combination yarn according to the invention before the heat treatment, and curve (4) shows the properties of the combination yarn according to the state of the art. This combination yarn had been obtained in the comparison batch without using filaments required according to the invention. The curves of FIG. 2 reveal that here, too, the heat treatment leads again to a very distinct improvement in the flow stress of the yarns thus treated and thus makes it possible to use the yarn treated in accordance with the invention for textile further processing. FIG. 2 further reveals that the yarn prepared according to the invention (curve 5), despite the increase in flow stress, has largely retained its extensibility compared with conventionally drawn yarns (curve 4).

Figure 3:
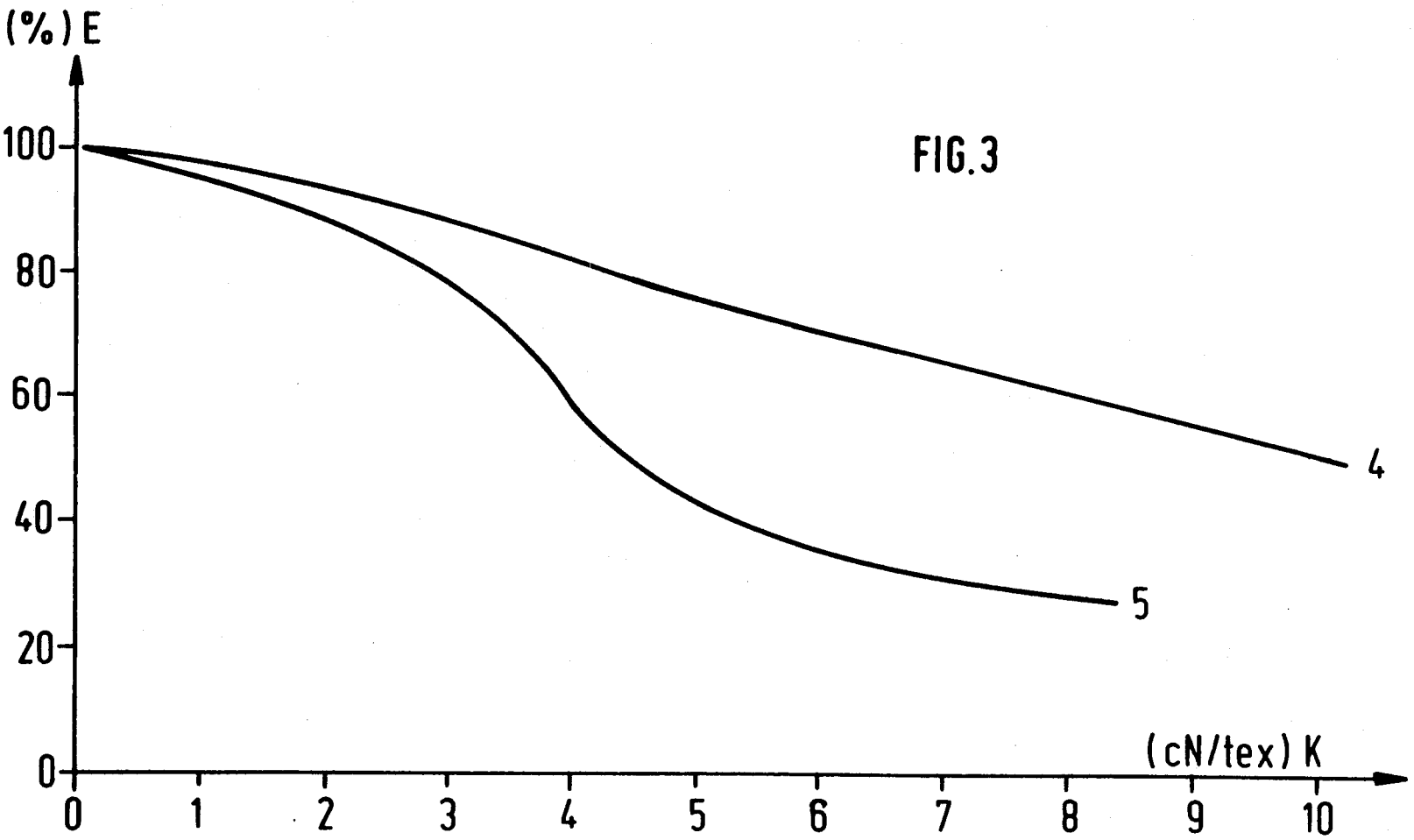
FIG. 3 shows a degree of elasticity/stress diagram of a textured combination yarn after the heat treatment and in accordance with the state of the art.

FIG. 3 is a plot of the degree of elasticity E against the yarn stress K. Of the curves, curve (5), as in FIG. 2, applies to a yarn according to the invention, i.e. to a yarn likewise obtained after the specified heat setting, while curve (4) produces the course of the degree of elasticity for a state of the art yarn. These values were determined by testing the comparative yarn of this example.

EXAMPLE 3

Example 2 was repeated with two high-speed spun polyester yarns as carrier component. The individual filaments had a birefringence of $35\times10^{-3}$, and these yarns were presented to the air jet texturing machine with an overfeed of 8%. The effect yarn comprised three yarns which likewise comprised polyethylene terephthalate filaments, but fully drawn and each having a linear density of dtex 150 f 64. These fully drawn yarns were false twist textured, unlike the smooth feed yarns for the carrier component. These particulars and the resulting textile values for breaking force, elongation at break and flow stress, in each case before and after the heat treatment according to the invention, are recorded in the table below. The designation "V" in the birefringence column indicates that these yarn components have been drawn and false twist textured.

EXAMPLE 4

Example 3 was repeated with variations in the yarns for the carrier component. The results are recorded in the table below.

EXAMPLE 5

The preceding Examples 3 and 4 were repeated, except that the filaments used for the carrier yarn component had different partial orientations. A birefringence range between 20 and $85\times10^{-3}$ was studied. The results obtained have been collated in the table below.

In addition, in run c of Example 5 the degree of elasticity before and after heat treatment was determined under a load of 5 cN/tex, and was found to be 15% before the heat treatment and 33% after this treatment.

EXAMPLE 6

The procedures of the preceding examples were repeated, except that the overfeed of the drawn and false twist textured yarns with a linear density of dtex 150 f 64 was varied between 41 and 101%, while the overfeed of the component yarns which eventually function as the carrier component was left at a constart 8%. The results have been collated in the table below.

In connection with these results it may be pointed out in particular that the textile values in the table have always been related to the overall linear density, i.e. that the linear density contribution of the non-carrier component was also included. The values of this example distinctly show that the non-carrier component can also make a certain contribution to the textile values of the overall yarn. This is true in particular of the runs in which the overfeed of the effect component did not differ all that much from the feed of the yarns for the carrier component. While the breaking strength remains relatively unaffected, the effect on the elongation at break is very distinct. With increasing overfeed of the effect yarn, i.e. of the non-carrier component, the elongation at break increases distinctly. In the case of the flow stress too, it is possible to observe a certain dependence on the overfeed. When the overfeed is low, the non-carrier component does still appear to make a certain contribution to the flow stress, while in the case of a high overfeed it is probable that the carrier component is substantially the sole determining factor of the flow stress of the yarn. Here too it may be pointed out once more that the flow stresses relate to the whole yarn. If the flow stresses observed are related to the carrier filaments only, the values observed are of course significantly higher.

EXAMPLE 7

Here too a yarn is prepared from a carrier and a non-carrier component, except that the ratio of these two components relative to each other was varied. The effect component used with an overfeed of 70% comprised 2 to 5 drawn and false twist textured 15-dtex 64-filament yarns. The values obtained can be seen in the table below.

It can be seen from these values that with an increase in the percentage portion of non-carrier effect yarn the breaking strength increases slightly but significantly while the elongation at break decreases systematically, albeit again only by small amounts. The flow stress too decreases with increasing non-carrier effect yarn content, and it is found here that the flow stress of the overall yarn is practically only predetermined by the carrier component. Increasing the non-carrier component then inevitably results in lower values solely because of the change in share.

EXAMPLE 8

The question studied was whether lengthening the heat treatment, i.e. a treatment with steam at 130° C. in an autoclave, additionally produces marked effects. In run a the heat treatment was two times 10 minutes, while in run b it was two times 20 minutes. The values obtained can be seen in the table below. No significant changes occurred.

EXAMPLE 9

In this example too the heat treatment was varied. In run a the heat treatment was one time 10 minutes in saturated steam at 130° C., while in run b only saturated steam at 120° C. was used for one time 10 minutes (see table below).

Here too no significant change was observed when varying the heat treatment.

EXAMPLE 10

In this example a variation in the non-carrier component was effected. In run a only fully drawn filaments which, however, had not been subjected to any false twist texturing were used, and in run b a smooth drawn component yarn was used for the non-carrier component, while two further component yarns had likewise been drawn but additionally also false twist textured.

| | Run | % overfeed | Buildup of yarn components Number | Count | Birefringence $\times 10^3$ | Tearing force (cN/tex) before heat treatment | after | Elongation at break (%) before heat treatment | after | Flow stress (cN/tex) before heat treatment | after |
|---|---|---|---|---|---|---|---|---|---|---|---|
| Example 3 | | 8 | 2 | 330f64 | 35 | 12.2 | 11.9 | 85.6 | 73.9 | 1.9 | 3.6 |
| | | 70 | 3 | 150f64 | V | | | | | | |
| Example 4 | | 8 | 2 | 192f64 | 39 | 13.0 | 12.3 | 80.1 | 69.0 | 1.5 | 2.9 |

-continued

| | | | | | | | | | | | |
|---|---|---|---|---|---|---|---|---|---|---|---|
| | | 70 | 3 | 150f64 | V | | | | | | |
| Example 5 | a | 8 | 2 | 245f64 | 20 | 11.0 | 9.2 | 84.7 | 73.8 | 1.3 | 2.4 |
| | | 70 | 3 | 150f64 | V | | | | | | |
| | b | 8 | 2 | 245f64 | 27 | 11.7 | 10.8 | 84.5 | 72.0 | 1.5 | 2.7 |
| | | 70 | 3 | 150f64 | V | | | | | | |
| | c | 8 | 2 | 245f64 | 37 | 12.6 | 12.4 | 82.7 | 71.5 | 1.7 | 3.0 |
| | | 70 | 3 | 150f64 | V | | | | | | |
| | d | 8 | 2 | 245f64 | 49 | 14.4 | 13.8 | 79.9 | 69.3 | 1.9 | 3.2 |
| | | 70 | 3 | 150f64 | V | | | | | | |
| | e | 8 | 2 | 245f64 | 65 | 15.4 | 14.2 | 73.9 | 63.7 | 2.2 | 3.4 |
| | | 70 | 3 | 150f64 | V | | | | | | |
| | f | 8 | 2 | 245f64 | 85 | 15.6 | 14.3 | 65.4 | 58.7 | 2.5 | 3.5 |
| | | 70 | 3 | 150f64 | V | | | | | | |
| Example 6 | a | 8 | 2 | 245f64 | 37 | 14.9 | 14.7 | 61.0 | 52.3 | 1.9 | 4.0 |
| | | 41 | 3 | 150f64 | V | | | | | | |
| | b | 8 | 2 | 245f64 | 37 | 13.9 | 13.8 | 65.7 | 59.7 | 1.8 | 3.9 |
| | | 51 | 3 | 150f64 | V | | | | | | |
| | c | 8 | 2 | 245f64 | 37 | 13.6 | 14.1 | 74.2 | 68.3 | 1.8 | 3.5 |
| | | 59 | 3 | 150f64 | V | | | | | | |
| | d | 8 | 2 | 245f64 | 37 | 12.6 | 12.4 | 82.7 | 71.5 | 1.7 | 3.5 |
| | | 70 | 3 | 150f64 | V | | | | | | |
| | e | 8 | 2 | 245f64 | 37 | 13.9 | 13.7 | 96.6 | 85.0 | 1.6 | 2.8 |
| | | 81 | 3 | 150f64 | V | | | | | | |
| | f | 8 | 2 | 245f64 | 37 | 13.6 | 13.9 | 107.4 | 96.0 | 1.4 | 2.7 |
| | | 90 | 3 | 150f64 | V | | | | | | |
| | g | 8 | 2 | 245f64 | 37 | 13.8 | 12.9 | 118.9 | 101.1 | 1.6 | 2.5 |
| | | 101 | 3 | 150f64 | V | | | | | | |
| Example 7 | a | 8 | 2 | 245f64 | 37 | 12.3 | 13.4 | 83.4 | 70.6 | 2.5 | 4.1 |
| | | 70 | 2 | 115f64 | V | | | | | | |
| | b | 8 | 2 | 245f64 | 37 | 13.0 | 13.2 | 81.3 | 70.0 | 2.0 | 3.6 |
| | | 70 | 3 | 115f64 | V | | | | | | |
| | c | 8 | 2 | 245f64 | 37 | 13.3 | 13.6 | 80.5 | 73.0 | 1.8 | 3.0 |
| | | 70 | 4 | 115f64 | V | | | | | | |
| | d | 8 | 2 | 245f64 | 37 | 13.9 | 14.2 | 79.7 | 76.0 | 1.5 | 2.5 |
| | | 70 | 5 | 115f64 | V | | | | | | |
| Example 8 | a | 8 | 2 | 245f64 | 37 | 12.6 | 12.4 | 82.7 | 71.5 | 1.5 | 2.7 |
| | | 70 | 3 | 150f64 | V | | | | | | |
| | b | 8 | 2 | 245f64 | 37 | 12.8 | 12.6 | 82.2 | 70.4 | 1.9 | 3.5 |
| | | 70 | 3 | 150f64 | V | | | | | | |
| Example 9 | a | 8 | 2 | 245f64 | 37 | 13.0 | 13.1 | 82.9 | 73.6 | 1.9 | 3.3 |
| | | 70 | 3 | 150f64 | V | | | | | | |
| | b | 8 | 2 | 245f64 | 37 | 13.2 | 13.2 | 84.0 | 75.1 | 2.0 | 3.2 |
| | | 70 | 3 | 150f64 | V | | | | | | |
| | | | | | | | | | | Degree of elasticity (%) after heat treatment | |
| Example 10 | a | 9 | 2 | 245f64 | 37 | | 10.8 | | 57.1 | | 41% |
| | | 70 | 3 | 150f64 | drawn | | | | | | |
| | b | 9 | 2 | 245f64 | 37 | | | | | | |
| | | 70 | 1 | 150f64 | drawn | | 12.8 | | 75.8 | | 28% |
| | | | 2 | 167f32 | V | | | | | | |

The results of Examples 3 to 10 can be summarized to the effect that steaming in the case of the yarns prepared here is associated, if at all, only with a small decrease in the breaking force. By contrast, a decrease in the elongation at break is more distinct. However, in the case of the elongation at break it is to be borne in mind that the yarns in the present case have been air jet textured. It is known that such a texturing process can give rise to microcracks or weak areas in the filaments. Such weak areas can easily lead to a mistaken idea of a reduced elongation at break. A check is possible in these cases by determining the elongation at break as a function of the clamping length of the filaments to be tested. It may even be necessary to extrapolate the elongation values measured at different clamping lengths to a very small test length.

The tables further reveal that the flow stress of the yarns increases by about 50 to 100% as a result of a yarn treatment according to the invention under tension.

EXAMPLE 11

Finally, polyester combination yarns were used to prepare sample fabrics: two fabrics were woven with the same design and sett (twill 2/2) on the one hand from combination yarns according to the invention and on the other from combination yarns according to the state of the art. The weights per unit area were 300 and 339 g/m$^2$ respectively, and the thread density was 11/cm.

The yarns according to the state of the art:

Warp: air jet textured yarn having an effective count dtex 1315f320 prepared from 2 yarns dtex 167f64 (drawn) with 10% overfeed and 3 yarns dtex 167f64 (drawn) with 70% overfeed Weft: air jet textured yarn having an effective count dtex 1253f288 prepared from 2 yarns dtex 167f64 (drawn) with 10% overfeed and 3 yarns dtex 167f64 (drawn)

1 yarn dtex 167f32 (drawn) with 46% overfeed

Yarns according to the invention:

Warp: air jet textured yarn having an effective count dtex 1239f160 prepared from 2 yarns dtex 300f32 (partially oriented, undrawn) with 10% overfeed 3 yarns dtex 167f32 (drawn) with 70% overfeed Weft: air jet textured yarn having an effective count dtex 1531f288 prepared from 2 yarns dtex 330f64 (partially oriented, undrawn) with 10% overfeed 2 yarns dtex 167f64 (drawn) with 46% overfeed 1 yarn dtex 167f32 (drawn)

Similar to the combination yarns of Example 2, the fabrics prepared here according to the invention likewise exhibit a flatter stress-strain curve, the fabric prepared with combination yarns required according to the invention having an elongation at break of about 60% in the warp and weft direction compared with an elongation at break of 36% of the fabric prepared with conventional yarns.

The advantage of the fabric prepared according to the invention from combination yarns is shown even more clearly in the determination of the degree of elasticity in line with DIN 53 835, Part 4, Item 3 6. To this end, 5 cm wide strips of the type also required in accordance with DIN 53 857 for tensile experiments on textile sheet structures were tested. It was found that under a load of 50 daN the degree of elasticity of the fabric comprising only fully drawn filaments was 65%. If on the other hand yarns according to the invention are used as warp and weft yarns as indicated above, a degree of elasticity of only 40% was found. In bursting strength tests in accordance with DIN 53 861 it was found that the bursting bulge height of the fabric prepared according to the invention of 33.7% is only three precent higher than that of the comparative fabric, while, however, the mass-specific bulging or bursting resistance is lower by 42%.

In addition to the bursting test a bulging test was carried out in which the bulge height was determined under an incremental increase of the measuring pressure from 0.5 daN/cm$^2$ to 4.0 daN/cm$^2$. At the same measuring pressure the height of the spherical cap bulge of the two fabrics measured above the center of the test area is initially fairly similar, but on increasing the pressure the fabric prepared according to the invention forms a larger bulge. Under a measuring pressure of about 4 daN/cm$^2$ the height of the bulge of the fabric according to the invention of about 35 mm is about 7 mm higher than that of the comparative fabric prepared from conventional yarns.

In this example the fabric prepared according to the invention comprised both in the warp and in the weft direction yarns whose carrier components comprised undrawn, partially oriented polyester filaments. Such fabrics are distinguished by a high irreversible formability in all spatial directions. If in special cases only a formability of the fabrics in one direction is desired, it is possible to dispense with the use of the yarns required according to the invention in the warp or weft direction.

We claim:

1. A method for preparing a yarn component containing at least one filament, said method comprising the steps of:

selecting, as said filament or filaments, at least one partially oriented, undrawn synthetic filament having a birefringence at least $20\times10^{-3}$ and an elongation at break of 70–200%, and subjecting the thus-selected filament or filaments to a heat treatment at 100°–180° C. under tension.

2. The method as claimed in claim 1, wherein the filament or filaments consist esentially of polyester.

3. The method as claimed in claim 1, wherein the yarn component is subjected to a texturing process before or after said heat treatment has been carried out.

4. The method as claimed in claim 1, wherein in the heat treatment, the filament or filaments are subjected to a temperature of 120°–150° C.

5. A method for preparing a one-component or multicomponent yarn, comprising the steps of:

selecting, as the filaments for said yarn, partially oriented, undrawn synthetic filaments having a birefringence of at least $20\times10^{-3}$ and an elongation at break of 70–200%, subjecting the thus-selected filaments to a heat treatment at 100°–180° C. under tension, and producing from the thus-treated filaments a yarn having a degree of elasticity under load of 5 cN/tex of less than 50%.

6. A method as claimed in claim 5, wherein a multicomponent yarn is produced by combining a carrier component, produced from said thus-treated filaments, and a second carrier component or a non-carrier component, the combining step being carried out before or after said heat treatment, whereby the carrier component produced from said thus-treated filaments accounts for at least part of the total combined carrier component of the resulting yarn.

7. A method as claimed in claim 5, wherein the filaments are essentially polyester filaments.

8. The method as claimed in claim 5, wherein, in the heat treatment, the filaments are subject to a temperature of 120°–150° C.

* * * * *